US006109889A

United States Patent [19]

Zengerle et al.

[11] Patent Number: 6,109,889

[45] Date of Patent: Aug. 29, 2000

[54] FLUID PUMP

[75] Inventors: Roland Zengerle; Manfred Stehr; Stephan Messner, all of Villingen-Schwenningen, Germany

[73] Assignee: Hahn-Schickard-Gesellschaft fur angewandte Forschung e.V., Villingen-Schwennington, Germany

[21] Appl. No.: 09/091,030

[22] PCT Filed: Dec. 3, 1996

[86] PCT No.: PCT/EP96/05382

§ 371 Date: Jun. 3, 1998

§ 102(e) Date: Jun. 3, 1998

[87] PCT Pub. No.: WO97/21924

PCT Pub. Date: Jun. 19, 1997

[30] Foreign Application Priority Data

Dec. 13, 1995 [DE] Germany ..... 195 46 570

[51] Int. Cl.[7] ..... F04B 17/00

[52] U.S. Cl. ..... 417/413.2; 417/413.3

[58] Field of Search ..... 417/53, 413.2

[56] References Cited

U.S. PATENT DOCUMENTS 4,231,287 11/1980 Smiley ..... 92/94
5,085,562 2/1992 Van Lintel ..... 417/413
5,180,288 1/1993 Richter et al. ..... 417/48
5,224,843 7/1993 Van Lintel ..... 417/413 A
5,336,062 8/1994 Richter ..... 417/413
5,529,465 6/1996 Zengerle et al. ..... 417/413.2
5,611,676 3/1997 Oomi et al. ..... 417/322
5,759,014 6/1998 Van Lintel ..... 417/413.3
5,759,015 6/1998 Van Lintel et al. ..... 417/322

*Primary Examiner*—Timothy S. Thorpe
*Assistant Examiner*—Ehud Gartenberg
*Attorney, Agent, or Firm*—Dougherty & Associates

[57] ABSTRACT

A fluid pump has a pump body and a displacer, the displacer and the pump body being implemented such that a pump chamber is defined therebetween, the pump chamber having an inlet opening and an outlet opening, neither the inlet opening nor the outlet opening being provided with a check valve. A drive means is provided which positions the displacer periodically at a first and at a second end position. The displacer closes the outlet opening when it occupies its first end position and leaves the outlet opening free when it occupies its second end position and leaves the inlet opening free at both end positions thereof. The displacer, when moving from the first to the second end position, defines a flow-through gap which opens between the displacer and the pump body in the area of the outlet opening in dependence upon the movement, the flow-through gap being defined such that the flow through the outlet opening depends on the pressure in the pump chamber as well as on the respective opening degree of the flow-through gap.

11 Claims, 12 Drawing Sheets

FLUID PUMP

BACKGROUND OF THE INVENTION

1. Field of the Invention

The present invention refers to a fluid pump, i.e. a pump for liquids and gases.

2. Description of Prior Art

It is known to use positive-displacement pumps for transporting fluids, said positive-displacement pumps consisting of a periodic displacer, a piston or a diaphragm, and two passive check valves. Due to the periodic movement of the piston or of the diaphragm, liquid is drawn into a pump chamber through the inlet valve and displaced from said pump chamber through the outlet valve. Due to the use of these valves, said known pumps are complicated and expensive. In addition, the direction of transport is predetermined by the arrangement of the valves. When the pumping direction of such an arrangement is to be reversed, such known pumps reuire a change of the operating direction of the valves from outside which entails a high expenditure. Such pumps are shown e.g. in Jarolav and Monika Ivantysyn; "Hydrostatische Pumpen und Motoren"; Vogel Buchverlag, Würzburg, 1993.

Pumps of this type having a small constructional size and delivering small pumped streams are referred to as micropumps. The displacers of such pumps are typically implemented as a diaphragm, cf. P. Gravesen, J. Branebjerg, O. S. Jensen; Microfluidics—A review; Micro Mechanics Europe Neuchatel, 1993, pages 143–164. The displacers can be driven by different mechanisms. Piezoelectric drive mechanisms are shown in H. T. G. Van Lintel, F. C. M. Van de Pol. S. Bouwstra, A Piezoelectric Micropump Based on Micromachining of Silicon, Sensors & Actuators, 15, pages 153–167, 1988, S. Shoji, S. Nakagawa and M. Esashi, Micropump and sample injector for integrated chemical analyzing systems; Sensors and Actuators, A21-A23 (1990), pages 189–192, E. Stemme, G. Stemme; A valveless diffuser/nozzle based fluid pump; Sensors & Actuators A, 39 (1993) 159–167, and T. Gerlach, H. Wurmus; Working principle and performance of the dynamic micropump; Proc. MEMS'95; (1995), pages 221–226; Amsterdam, The Netherlands. Thermopneumatic mechanisms for driving the displacers are shown in F. C. M. Van de Pol, H. T. G. Van Lintel, M. Elwenspoek and J. H. J. Fluitman, A Termo-pneumatic Micropump Based on Micro-engineering Techniques, Sensors & Actuators, A21-A23, pages 198–202, 1990, B. B üstgens, W. Bacher, W. Menz, W. K. Schomburg; Micropump manufactured by thermoplastic molding; Proc. MEMS'94; (1994), pages 18–21. An electrostatic mechanism is shown in R. Zengerle, W. Geiger, M. Richter, J. Ulrich, S. Kluge, A. Richter; Application of Micro Diaphragm Pumps in Microfluid Systems; Proc. Actuator '94; 15.–17.6.1994; Bremen, Germany; pages 25–29. Furthermore, the displacers can be driven thermomechanically or magnetically.

As is also shown in the above-mentioned publications, either passive check valves or special flow nozzles can be used as valves, said check valves and said flow nozzles being both expensive and complicated. The direction of transport of micropumps can be reversed without forcibly controlling the valves, simply by effecting control at a frequency above the resonant frequency of said valves. In this context R. Zengerle, S. Kluge, M. Richter, A. Richter; A Bidirectional Silicon Micropump; Proc. MEMS '95; Amsterdam, Netherlands; pages 19–24, J. Ulrich, H. Füller, R. Zengerle; Static and dynamic flow simulation through a KOH-etched micro valve; Proc. TRANSDUCERS '95, Stockholm, Sweden, (1995), pages 17–20, should be taken into account. The cause of this effect is a phase displacement between the movement of the displacer and the opening state of the valves. If the phase difference exceeds 90°, the opening state of the valves is anticyclic to their state in the normal forward mode and the pumping direction is reversed. A change of the operating direction of the valves from outside of the type required when macroscopic pumps are used can be dispensed with. The decisive phase difference between the displacer and the valves depends on the drive frequency of the pump on the one hand and on the resonant frequency of the movable valve member in the liquid surroundings on the other.

One disadvantage of this embodiment is to be seen in the fact that, upon constructing the valves, a compromise has to be found between the mechanical resonance in the liquid surroundings, the flow resistance, the fluidic capacity, i.e. the elastic volume deformation, the constructional size and the mechanical stability of these valves. It follows that these parameters, each of which may influence the pumping dynamics, cannot be ajusted to an optimum value independently of one another and part of them is opposed to a desired further miniaturization of the pump dimensions.

A general disadvantage entailed by the use of pumps with passive check valves is also the fact that, when switched off, the pumps do not block the medium to be transported. If the input pressure exceeds the output pressure by the pretension of the valves, the medium to be pumped will flow through the pump.

Micropumps using special flow nozzles have the disadvantage that they have a very low maximum pumping efficiency in the range of 10 to 20%.

DE-C 19534378.6 discloses a fluid pump comprising a pump body, a displacer and an elastic buffer. The displacer closes an inlet arranged in said pump body when occupying a first end position and leaves said inlet arranged in the pump body free when occupying a second end position. The known pump permits a net flow through an outlet which is also provided in the pump body. The buffer means bordering on the pump chamber formed by the displacer and the pump body makes the known fluid pump expensive and complicated.

Esashi, Shoji and Nakano describe in the article "Normally closed microvalve and micropump fabricated on a silicon wafer", Sensors and Actuators 20 (1989), pages 163–169, a gas microvalve which is normally closed. The valve consists of a glass plate having arranged therein a gas outlet opening which is adapted to be closed by means of a silicon-mesa structure that is provided with a valve seat and that is adapted to be operated by a piezoelectric drive. The silicon layer, in which the silicon-mesa structure is formed, and the glass plate additionally define a continuous channel between the gas outlet opening and a gas inlet opening formed in the silicon layer. The above-mentioned publication also describes a diaphragm-type micropump consisting of two one-way valves and a diaphragm with a piezoelectric drive means.

SUMMARY OF THE INVENTION

Starting from the prior art cited, it is the object of the present invention to provide an efficient fluid pump having a simple structural design and to provide a method for operating such a pump.

In accordance with a first aspect of the present invention, this object is achieved by a fluid pump, comprising:

a pump body;

a displacer, said displacer and said pump body being implemented such that a pump chamber is defined therebetween, said pump chamber having an inlet opening and an outlet opening, neither said inlet opening nor said outlet opening being provided with a check valve;

a drive means positioning the displacer periodically at a first and at a second end position, the displacer closing said outlet opening when it occupies its first end position and leaving said outlet opening free when it occupies its second end position and leaving the inlet opening free at both end positions thereof, said displacer, when moving from the first to the second end position, defining a flow- through gap which opens between the displacer and the pump body in the area of the outlet opening in dependence upon said movement, said flow-through gap being defined such that the flow through the outlet opening depends on the pressure in the pump chamber as well as on the respective opening degree of said flow-through gap.

In accordance with a second aspect of the present invention, this object is achieved by a method of operating a fluid pump having the construction mentioned above, wherein during a suction phase in the course of which the displacer is moved from the first to the second end position an essentially linearly increasing voltage is applied to the drive means, and at the beginning of a pressure phase in the course of which the displacer is moved from the second to the first end position the voltage applied to the drive means is abruptly switched off.

The present invention provides a fluid pump comprising a pump body and a displacer, which is adapted to be periodically positioned at a first and at a second end position with the aid of a drive means, said displacer and said pump body being implemented such that a pump chamber is defined therebetween, said pump chamber having an inlet opening and an outlet opening. The displacer closes the outlet opening when it occupies its first end position and leaves said outlet opening free when it occupies its second end position. When the displacer moves from the first to the second end position, it opens a flow-through gap between the pump body and the displacer in the area of the outlet opening. The pump body is preferably implemented in the form of a plate including said inlet and outlet openings, whereas the displacer is provided with a recess defining the pump chamber.

The pumping efficiency can be optimized by adapting the cross-sectional areas of the inlet and outlet openings and by controlling the timing of the driving of the displacer into the first and second end positions. The displacer can be driven by a piezoelectric bending converter or a piezoplate secured in position by means of an adhesive or it can also be driven electrostatically.

A fluid pump according to the present invention has a simple structural design which may consist of a single structured silicon chip. This permits a reduction of the costs for processing the silicon components and also a reduction of mounting costs. A further saving of costs is achieved when the pump according to the present invention is produced from plastic material by precise mechanical processes, such as injection moulding, etc.

The displacer of the fluid pump according to the present invention is driven by a driving voltage having a polarity of such a nature that the displacer is raised. When the pump has been switched off, the polarity of the driving voltage can be reversed, whereby the outlet opening is closed with a defined, high contact force. Hence, the outlet opening defines together with the displacer an active valve which represents an essential advantage in comparison with passive valves. By introducing a small buffer volume into the pump chamber, it is further possible to reverse the pumping direction of a fluid pump according to the present invention, whereby the use of a second pump can be dispensed with in most cases.

BRIEF DESCRIPTION OF THE DRAWING

In the following, preferred embodiments of the present invention will be explained in detail making reference to the drawings enclosed, in which.

DESCRIPTION OF PREFERRED EMBODIMENTS OF THE INVENTION

Figure 1:
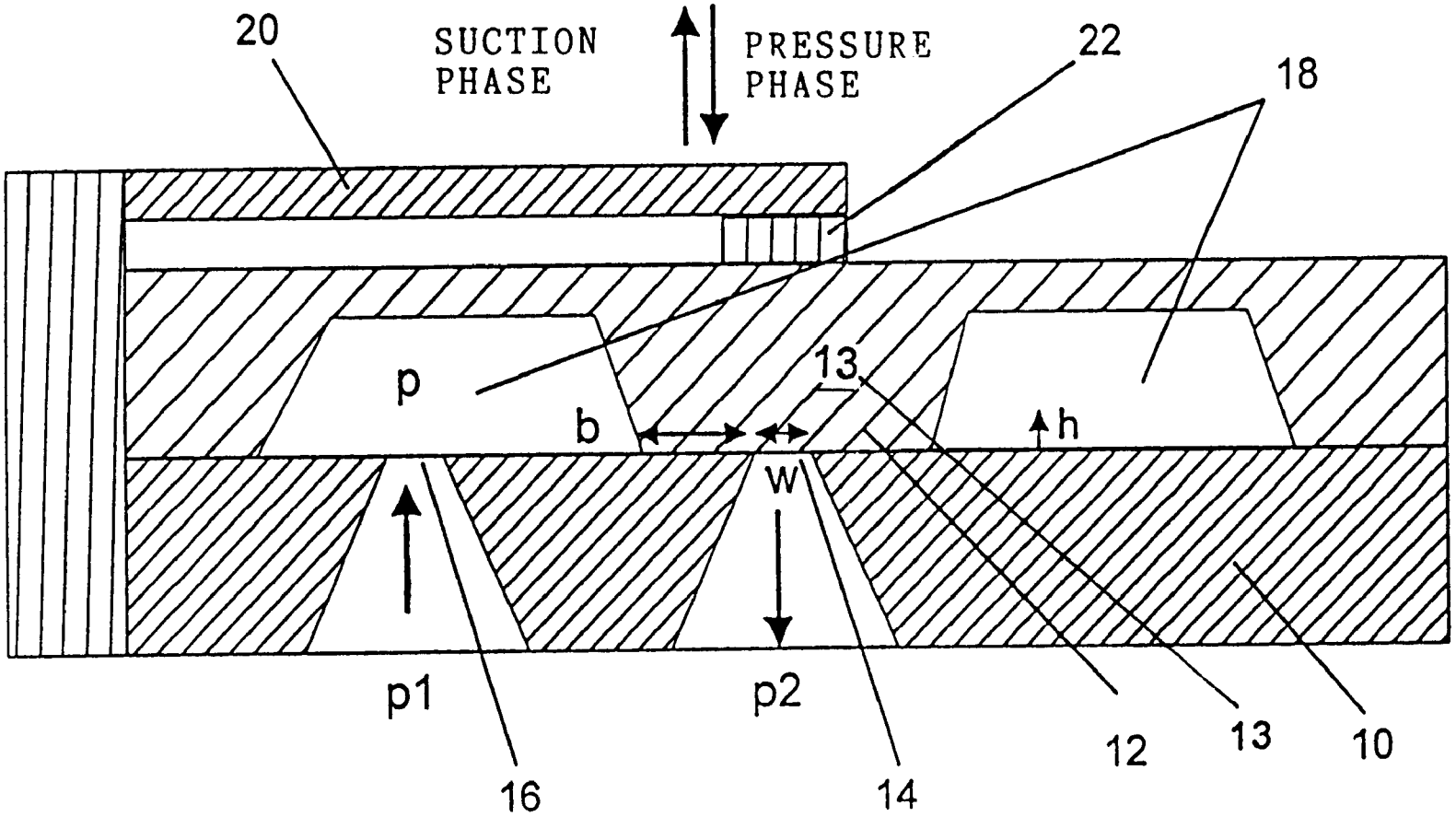
FIG. 1 shows a cross-sectional view of an embodiment of a fluid pump according to the present invention.

FIG. 1 shows a preferred embodiment of a fluid pump according to the present invention. The pump comprises a pump body 10 and a displacer 12. The pump body has formed therein an outlet opening 14 having a width w and an inlet opening 16. The outlet opening 14 and the inlet opening 16 can have an arbitrary shape, e.g. a square, a round, a rectangular or an ellipsoid shape. The displacer 12 is secured to the pump body 10 and is provided with a recess defining together with said pump body 10 a pump chamber 18. The pump body 10 and the displacer 12 can have e.g. a circular shape.

The displacer 12 is adapted to be moved to and fro into first and second end positions by means of a piezo bending converter 20 consisting of pieoelectric ceramics. The piezo bending converter 20 is secured to the displacer 12 e.g. by means of an adhesive 22. The displacer 12 defines at its central, thicker portion 13*a* valve together with the outlet opening 14, said outlet opening 14 being closed at the first end position of the displacer 12 and open at the second end position of the displacer 12.

When a voltage is applied to the piezo bending converter 20, the displacer 12 will move upwards to the second end position and open the outlet opening 14. When the voltage is switched off, the displacer 12 will move downwards to the first end position where it closes the outlet opening 14. The inlet opening, which can be implemented as an orifice, is permanently open.

A general consideration of the mode of operation of the pump according to FIG. 1 follows. As the displacer 12 moves, both a pressure p in the pump chamber 18 and a gap height h at the outlet opening 14 change. The flow through the outlet opening depends on these two factors, the pressure p and the gap height h. A simplified consideration results in a flow rate $\phi$ proportional to $ph^3$, the relationship in the case of a more general consideration being $p^x h^y$ where x and y are arbitrary numbers.

When the temporal integration over the flow is different for the opening and closing processes of the displacer 12, a net fluid transport in an indicated pumping direction through the outlet opening 14 will result when the displacer 12 is actuated periodically. This net fluid transport can be calculated by a mathematical integration over the flow rate.

Figure 2:
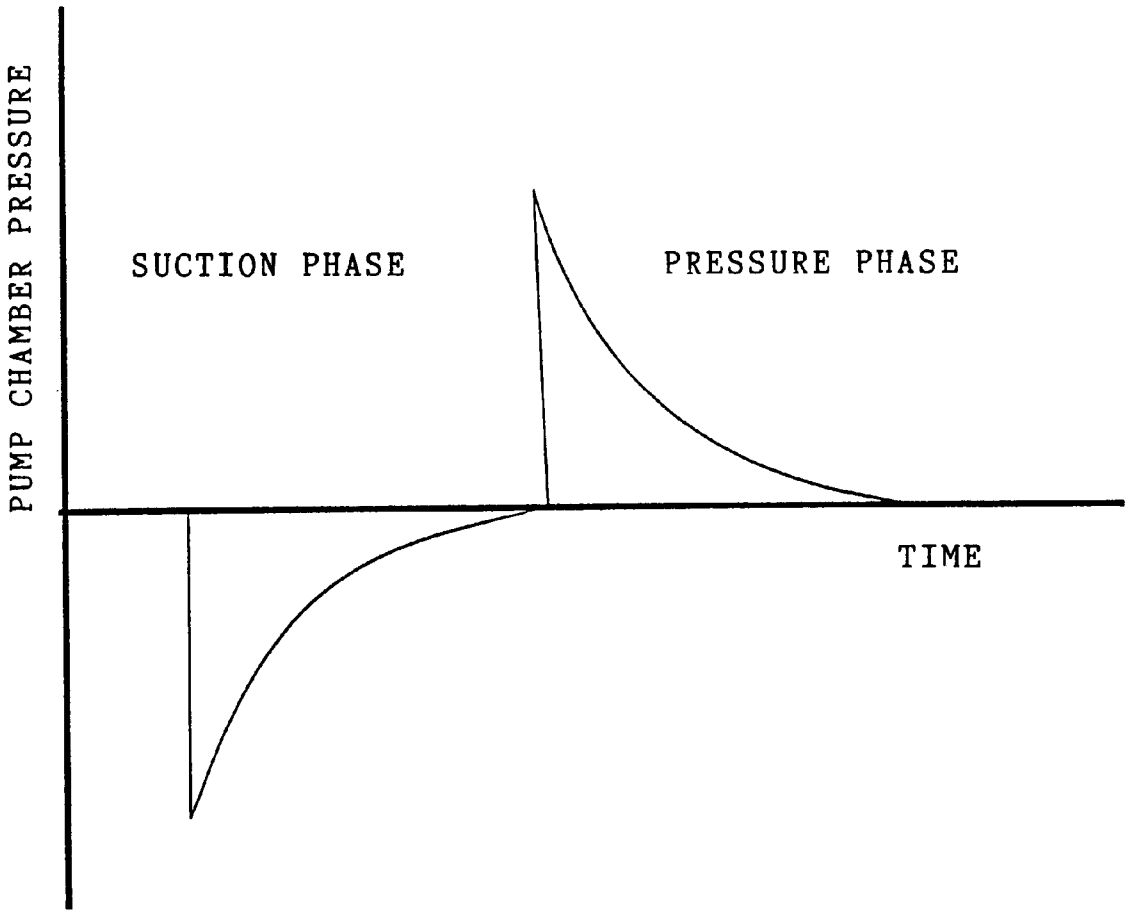
FIG. 2 shows the pressure in the pump chamber of a fluid pump according to the present invention during a suction phase and a pressure phase.

FIG. 2 shows the pressure characteristic with time in the pump chamber 18 when the piezo bending converter 20 is controlled by a square-wave voltage. When the voltage is applied, a underpessure is first created in the pump chamber 18, said underpressure decreasing as the degree of displacement of the displacer 12 increases. The displacement of the displacer 12 corresponds to the gap height h. When the voltage is switched off, or, alternatively, reversed, an excess pressure is obtained in the pump chamber 18, said excess pressure decreasing when the displacement of the displacer 12 decreases.

The time-dependent flows through the two openings in the pump body 10, the outlet opening 14 and the inlet opening 16, are now fundamentally different. Whereas the flow through the inlet opening 16 is only determined by the pressure characteristic in the pump chamber 18, the flow through the outlet opening 14 depends on the instantaneous pressure p in the pump chamber as well as on the instantaneous gap height h at the outlet opening 14.

The amount of flow through the inlet opening or inlet orifice is given by $$\phi_{inlet} = A_{orifice} \cdot \mu \cdot \sqrt{2\frac{|p_1 - p|}{\rho}} \tag{1}$$

in a first approximation, where $A_{orifice}$ is the cross-sectional area of the inlet opening or orifice 16, $\mu$ is a geometry-dependent, dimensionless outflow coefficient, $\rho$ is the density of the fluid, $p_1$ is the pressure in the inlet ending in the inlet opening (cf. FIG. 1), and p is the pump chamber pressure.

The flow through the outlet opening can, however, approximately be considered to be a laminar gap flow, which is given by:

$$\phi_{outlet} = \frac{1}{3}\frac{wh^3(p - p_2)}{\eta b} \tag{2}$$

Where w is the width of the outlet opening, h is the displacement of the displacer, b is the length of the respective gap (cf. FIG. 1), $\eta$ is the viscosity of the fluid and $p_2$ is the pressure in the outlet ending in the outlet opening (cf. FIG. 1).

Figure 3:
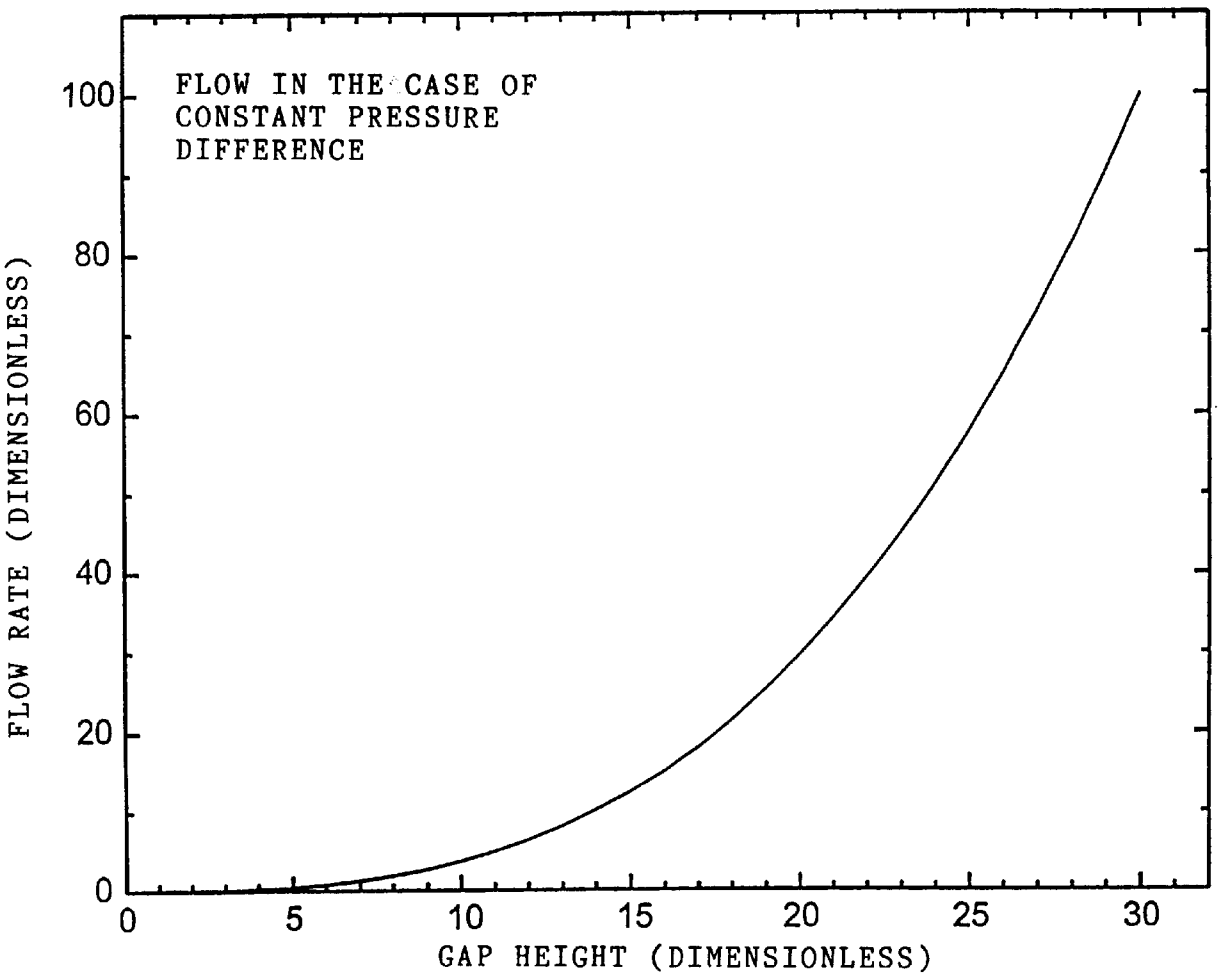
FIG. 3 shows a graph showing the dependence of the flow through the outlet opening on the gap width.

The flow through the outlet opening in dependence upon the gap height h is shown for a constant pressure difference in FIG. 3. Especially for low gap heights h, the flow rate is drastically reduced.

The fact that the flow through the outlet opening depends on the two independent variables, viz. the pump chamber pressure p and the gap height h, is of decisive importance for the pumping mechanism of the fluid pump according to the present invention.

In FIGS. 4*a* to 4*d*, the transient processes occurring during the suction phase and during the pressure phase in the pump according to FIG. 1 are shown in the form of a diagram.

Figure 4:
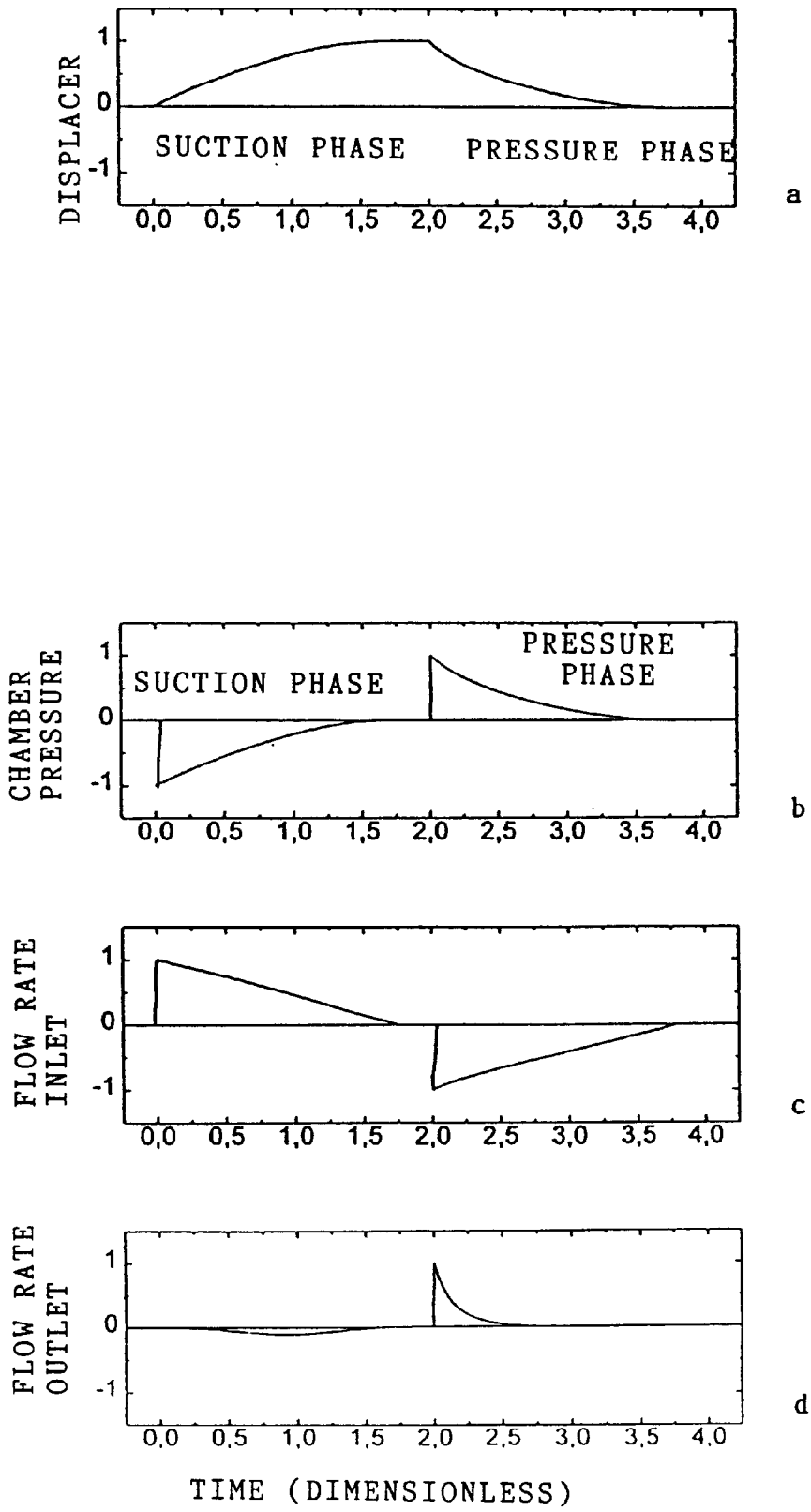
FIGS. 4*a* to 4*d* show representations of the transient processes taking place in the fluid pump of FIG. 1.

FIG. 4*a* shows the curve of the displacer movement; FIG. 4*b* shows the curve of the pump chamber pressure p; FIG. 4*c* shows the flow through the inlet opening and FIG. 4*d* the flow through the outlet opening.

Suction Phase

When the voltage applied to the piezo bending converter is switched on, an underpressure will immediately prevail in the pump chamber without there being any appreciable upward movement of the displacer. This is shown at the time 0.0 in FIGS. 4*a* and 4*b*. Since the outlet opening is still closed at this time, no fluid will flow through said opening. The fluid will first flow exclusively through the inlet opening into the pump chamber (cf. time 0.0 in FIGS. 4*c* and 4*d*). Only an increasing movement of the displacer and a resultant increase in the gap height h will cause an additional flow of fluid through the opening that is being formed. Since, however, the underpessure in the pump chamber decreases again during the movement of the displacer, the fluid volume flowing through the outlet opening is comparatively small because the flow is proportional to the product $ph^3$.

Pressure Phase

When the voltage applied to the piezo bending converter is switched off (time 2.0 in FIGS. 4*a* to 4*d*), an excess pressure will immediately prevail in the pump chamber without any appreciable downward movement of the displacer taking place. In this condition, the outlet opening is open and a comparatively high excess pressure prevails simultaneously in the pump chamber. Hence, the product $ph^3$ is comparatively large. It follows that the amount of fluid flowing through the outlet opening out of the pump chamber in the pressure phase exceeds by far the amount of fluid which has flown through the outlet opening into the pump chamber in the suction phase, as can be seen from FIG. 4*d*. This figure clearly shows the dissymmetry of the flow through the outlet opening in the pressure phase and in the suction phase and the resultant net flow through the outlet opening.

The net pumping effect of the fluid pump according to the present invention is based on the circumstance that different amounts of fluid flow through the gap between the displacer and the outlet opening while the outlet opening is being opened, i.e. during the suction phase, and while the outlet opening is being closed, i.e. during the pressure phase. The reason for this is that the flow through the outlet opening depends both on the pressure in the pump chamber and on the gap height h between the displacer and the pump body.

In the following, alternative embodiments of the present invention will be described.

The pumping efficiency of a pump according to the present invention, i.e. the amount of fluid pumped per pumping cycle, and the maximum counterpressure that can be achieved in the pump chamber can be varied by modifying the cross-sections of the two openings. Especially a reduction of the cross-sectional area of the inlet opening relative to the cross-sectional area, i.e. the width w, of the outlet opening will result in an increase of the maximum pressure. The pressure efficiency can additionally be improved by an optimized characteristic of the control voltage.

Figure 5:
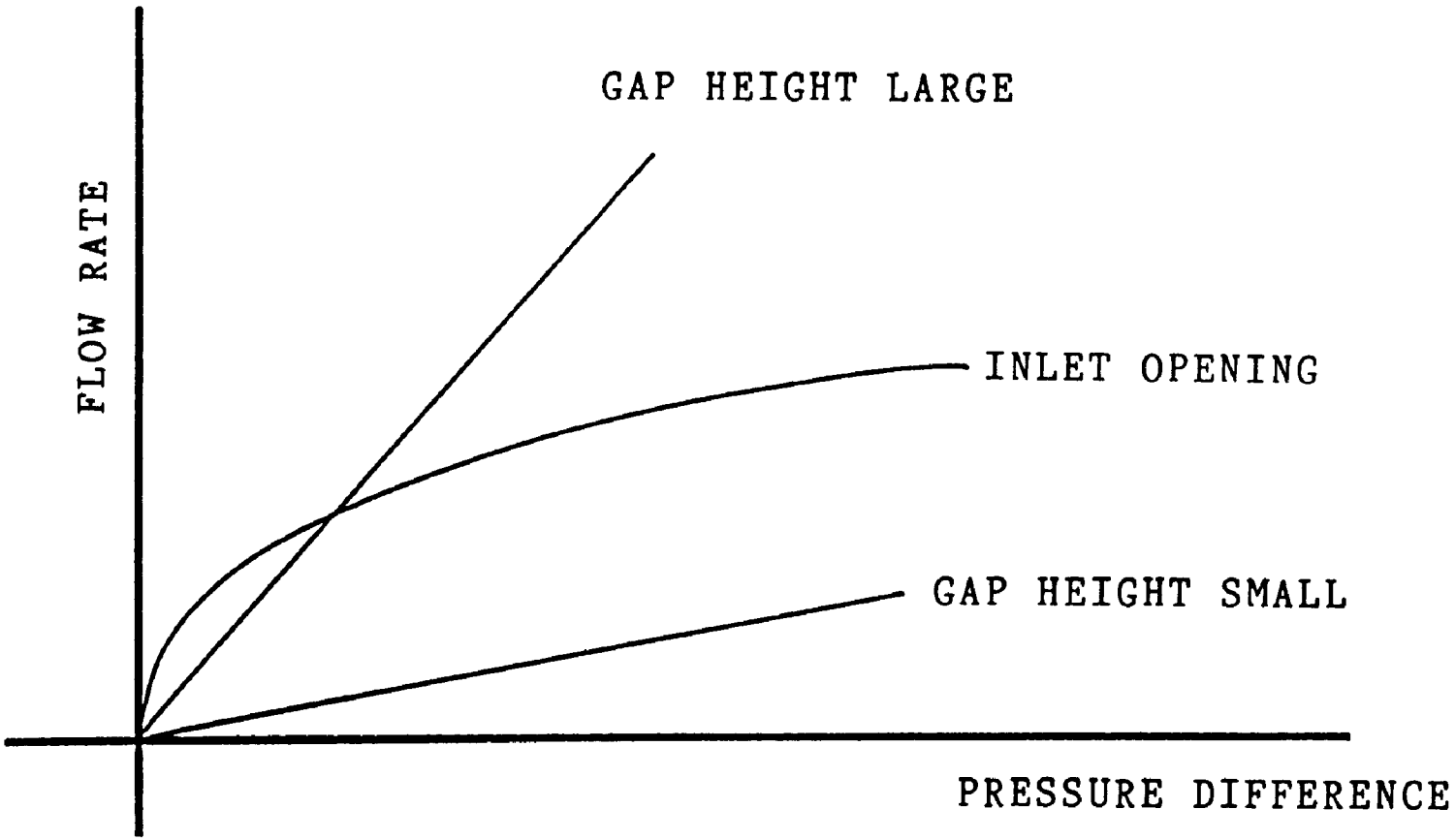
FIG. 5 shows the dependence of the flow through the inlet and outlet openings in the case of various pressure differences.

This consideration is based on the observation that the flow characteristic of the inlet opening, which is proportional to $\sqrt{p}$, has an almost perpendicular gradient starting from its origin, whereas, in the case of a constant gap height h, the flow through the outlet opening increases only linearly as the pressure increases. These effects are shown in FIG. 5. The flow through the inlet opening will therefore always predominate when the pressure differences are small. It follows that, when the pressure in the pump chamber is deliberately kept low during the suction phase and deliberately kept high during the pressure phase, it will be possible to enhance the pumping efficiency.

Figure 6:
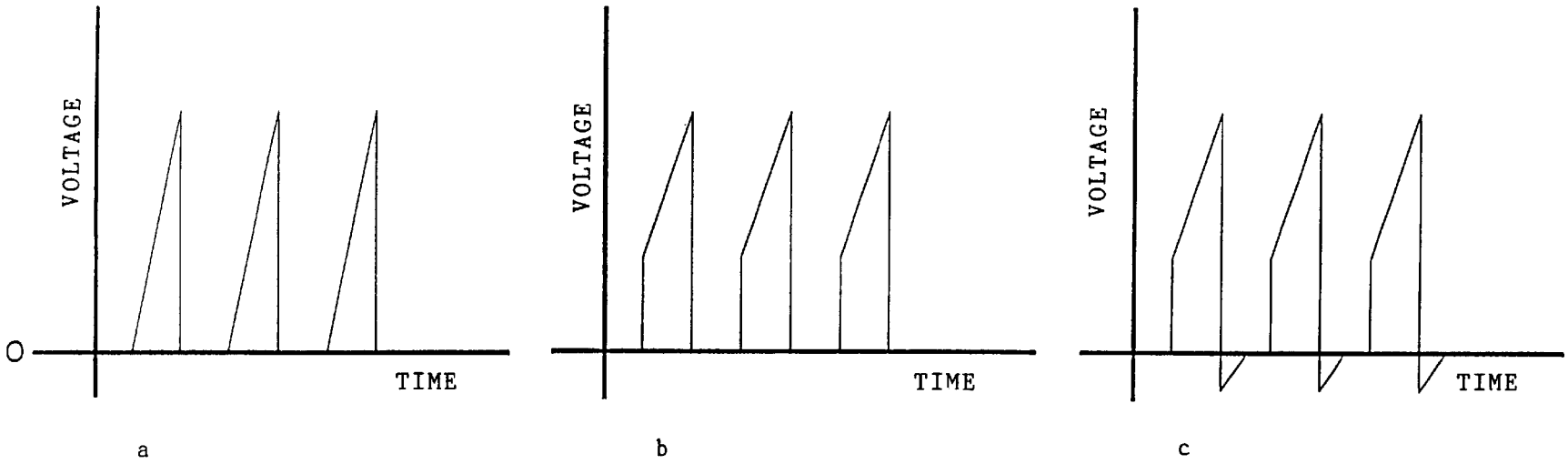
FIG. 6*a* to 6*c* show different control voltages for driving the displacer of a fluid pump according to the present invention.

In the case of a given control voltage U, the pressure in the pump chamber adjusts itself in such a way that there is an equilibrium of forces beween the pump drive, the intrinsic strain of the displacer and the hydrostatic pressure of the fluid in the pump chamber. FIGS. 6*a,* 6*b* and 6*c,* show two possibilities of advantageously modifying the pressure in the pump chamber by a suitable control voltage.

A feature which the voltage characteristics shown in FIGS. 6*a* to 6*c* have in common is a linear voltage increase during the suction phase and abrupt switching off of the voltage during the pressure phase. In the case of the voltage characteristic of FIG. 6*c,* the polarity of the voltage is also deliberately reversed at the beginning of the pressure phase, whereby the pressure in the pump chamber will be increased beyond normal. By means of such control voltages, the pumping efficiency can be increased deliberately. In addition, it is also clearly evident that the displacer can be closed either by its mechanical restoring force alone, due to its deformation (passively), or via the drive means (actively).

Hence, the decisive point of the pumping mechanism according to the present invention is to be seen in the fact that, as the displacer moves, both the pressure p in the pump chamber and the height of the flow gap at the outlet opening change. The flow through the outlet opening is composed of these two factors. A simplified consideration results in a flow rate $\phi$ proportional to $ph^3$; in the case of a more general consideration, the flow rate is proportional to $p^x h^y$ where x and y are arbitrary numbers.

It is explicitly pointed out that all relationships $p^x h^y$ between the pump chamber pressure p and the gap height h result in a pumping effect, provided that different values for the amount of fluid flowing through the outlet opening are obtained during the integration in the course of the opening and closing processes of the outlet opening by the displacer. Hence, it is also evident that a laminar gap flow through the valve is not a prerequisite for the pumping function. A pumping effect is also possible when the flow in question is a turbulent flow or any mixed kind of flow.

Figure 7:
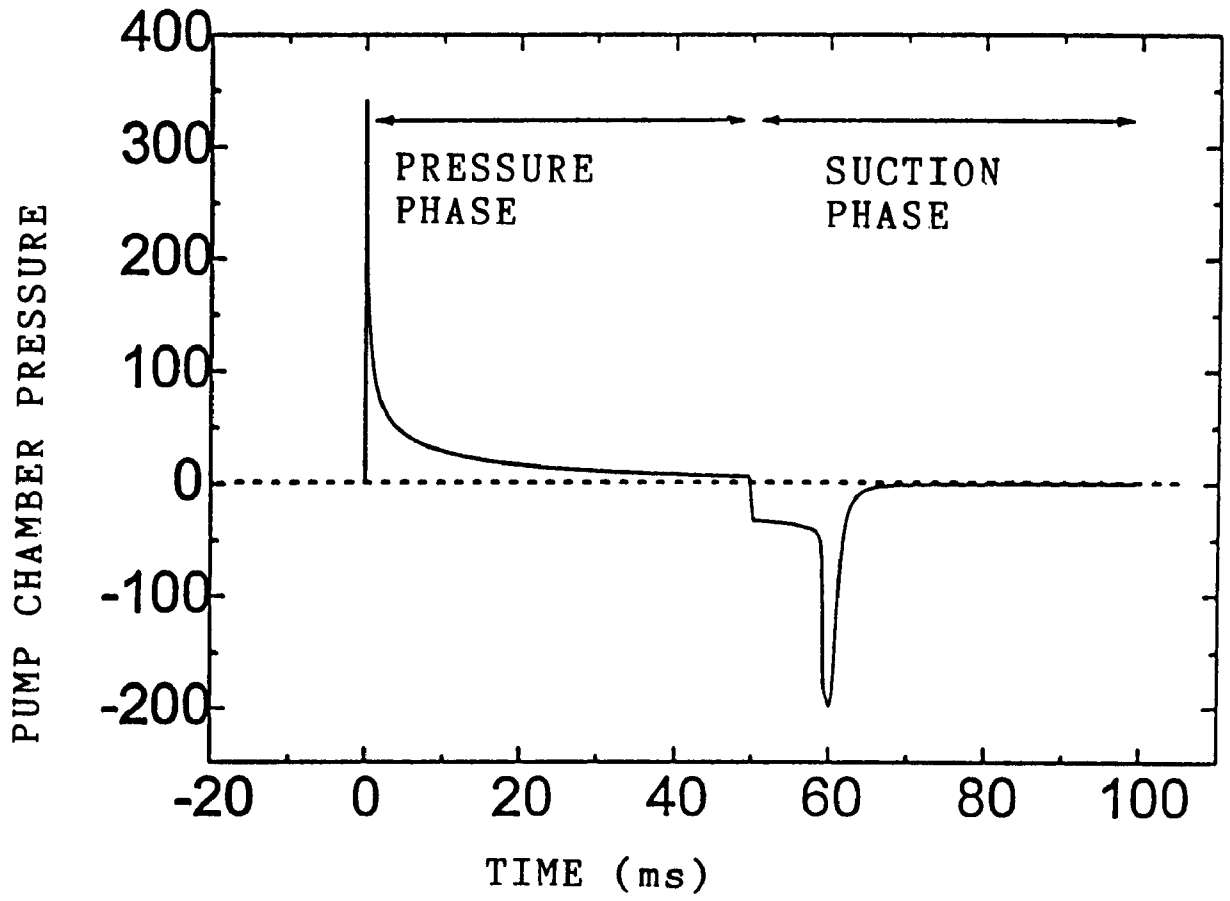
FIG. 7 shows a graph showing a special pressure characteristic in the pump chamber of a pump according to the present invention.

In order to achieve a good pumping efficiency, special pressure characteristics in the pump chamber may be advantageous. A pressure characteristic of this type is shown in FIG. 7. Such a pressure characteristic can be achieved e.g. by means of an electrostatic drive or by means of a deliberate modification of the control voltage (cf. FIG. 6).

Figure 8:
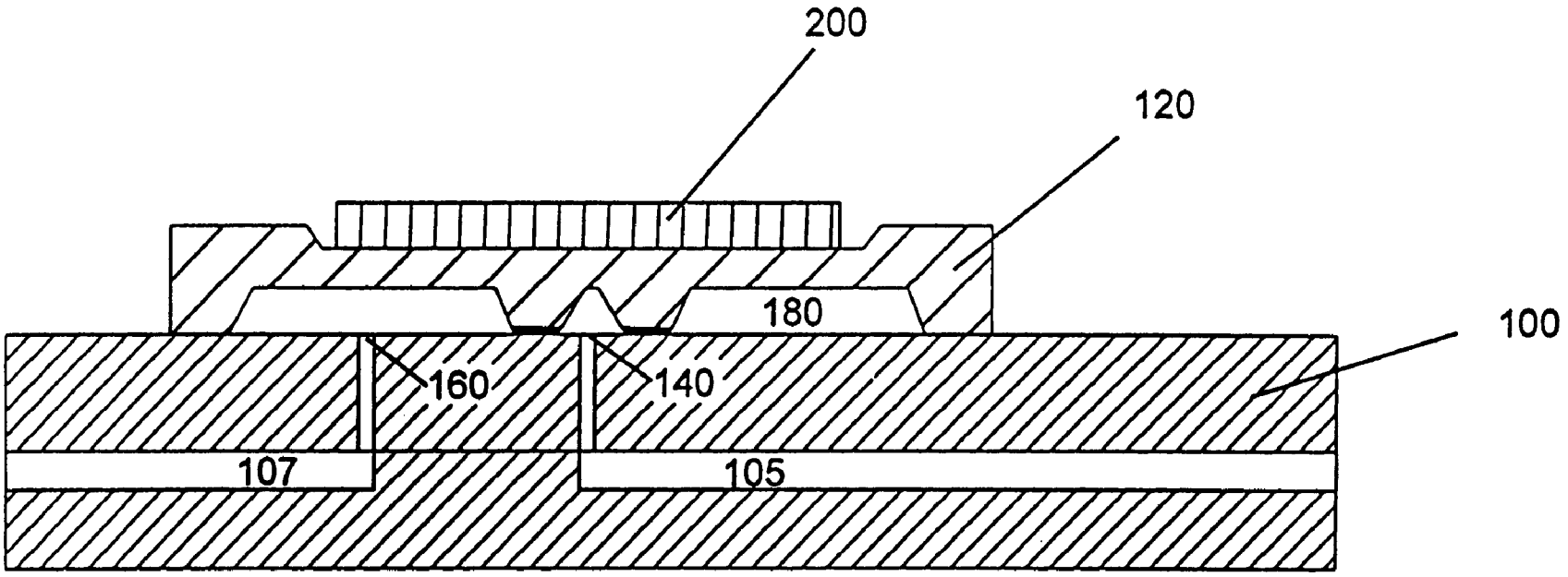
FIGS. 8 and 9 show various embodiments of a fluid pump according to the present invention.

FIG. 8 shows an alternative embodiment of the present invention. The pump body 100 of this embodiment consists of a fluidic base plate with integrated channels 105 and 107, which end in an outlet opening 140 and an inlet opening 160, respectively. A structured silicon chip serves as displacer 120, said silicon chip being secured to the fluidic base plate and being implemented such that it closes the outlet opening 140 at a first end position and leaves said outlet opening free at a second end position. In addition, a pump chamber 180 is defined by a recess provided in the displacer 120. The component used as a drive means in the embodiment shown in FIG. 8 is a piezoelectric ceramic plate, which is secured to the displacer and which can be provided with a layer for selective bonding on the upper surface thereof.

Figure 9:
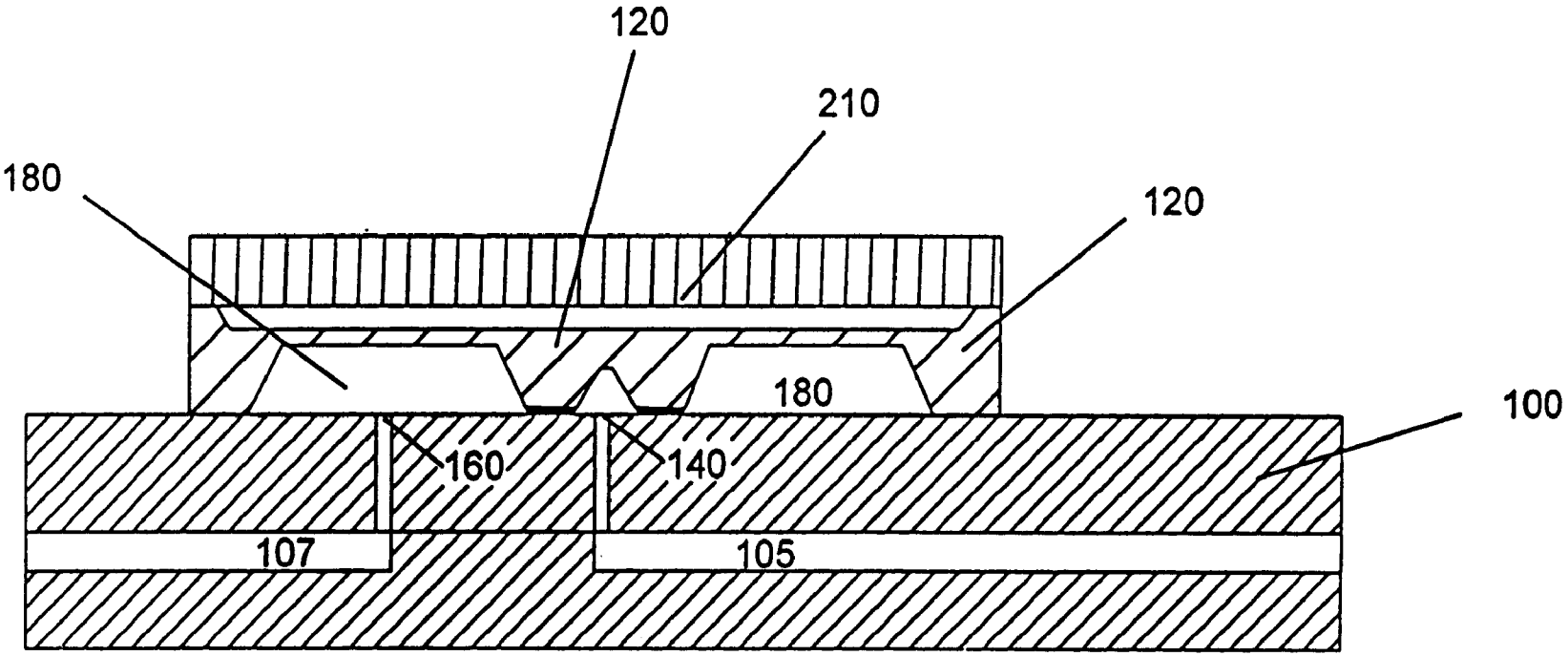

In FIG. 9 a further embodiment of the present invention is shown, which corresponds to the embodiment of FIG. 8 with the exception of the drive means used for the displacer. In the embodiment shown in FIG. 9, an electrostatic drive of the displacer has been realized. For this purpose, a counterelectrode 210 is arranged in spaced relationship with the displacer 120 above the side of said displacer located opposite the pump body 100, said counterelectrode being used for moving the displacer to the first and to the second end position. An electrostatic drive has the advantage that it permits, simply on the basis of the non-linear electrostatic driving forces, a highly unsymmetrical pressure characteristic in the pump chamber during the suction phase and during the pressure phase, said pressure characteristic being shown e.g. in FIG. 7.

In FIGS. 10*a* to 10*d* further embodiments used for controlling the displacer are shown. As far as these embodiments are concerned, it can be differentiated between a pointwise or an areawise introduction of force. Another differentiating criterion in connection with such control means is whether they permit a forcible control or a control allowing a reaction. When a forcibly controlled displacer is used, there will be no reaction coupling between the displacer position and the pump chamber pressure.

Figure 10:
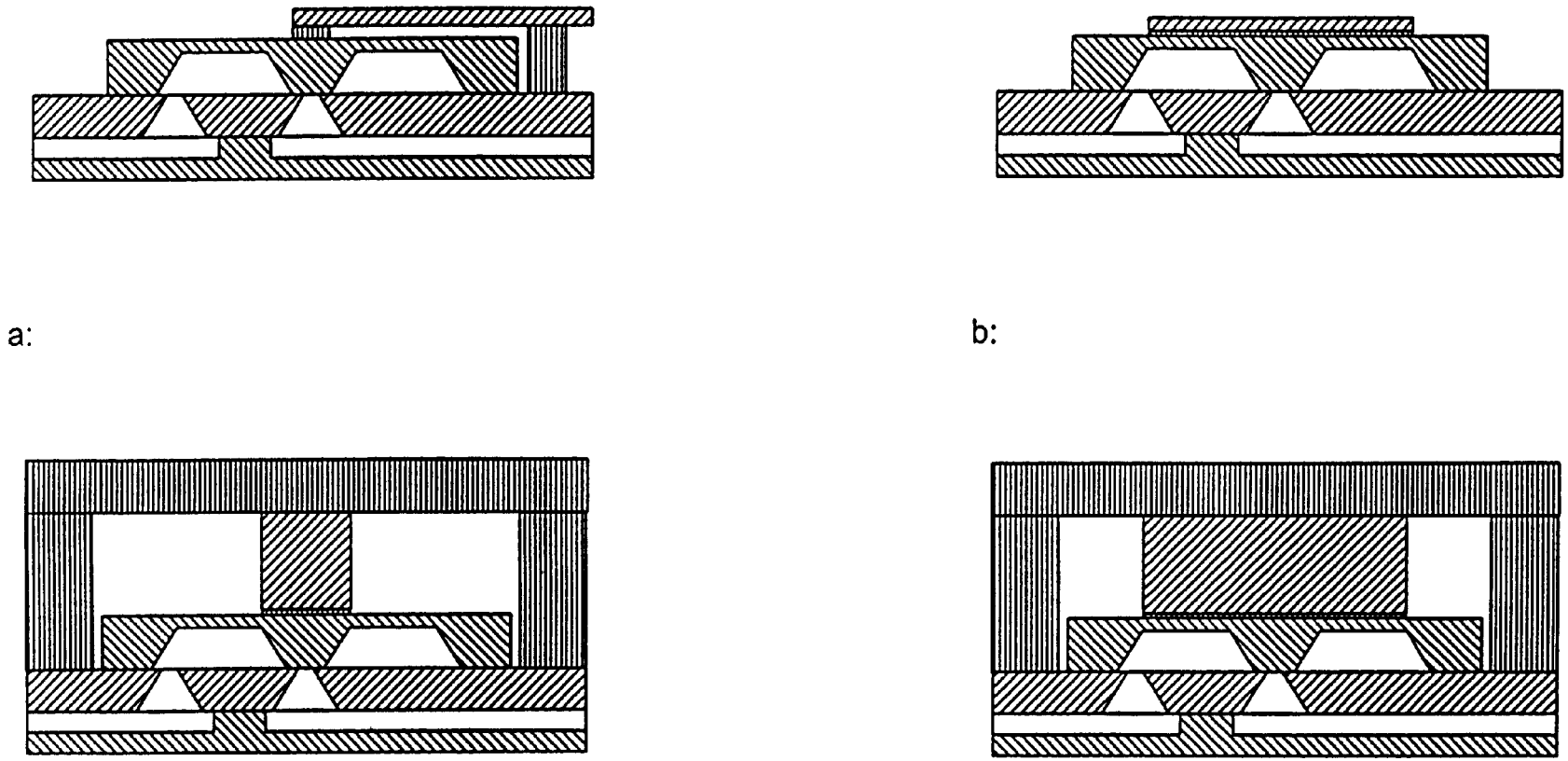
FIGS. 10*a* to 10*d* show four further embodiments used for controlling the displacer according to the present invention.

FIG. 10*a* shows a drive means for a pointwise introduction of force without a forcibly controlled displacer. FIG. 10*b* shows a drive means for an areawise introduction of force without a forcibly controlled displacer. In FIGS. 10*c* and 10*d,* respectively, drive means are shown for a pointwise and an areawise introduction of force with a forcibly controlled displacer.

In order to increase the pumping efficiency, it may also be advantageous to implement the orifice, i.e. the inlet opening, as a flow nozzle, such flow nozzles being normally provided in so-called diffusor nozzle pumps. This will have an additional positive effect on the pumping direction.

Figure 11:
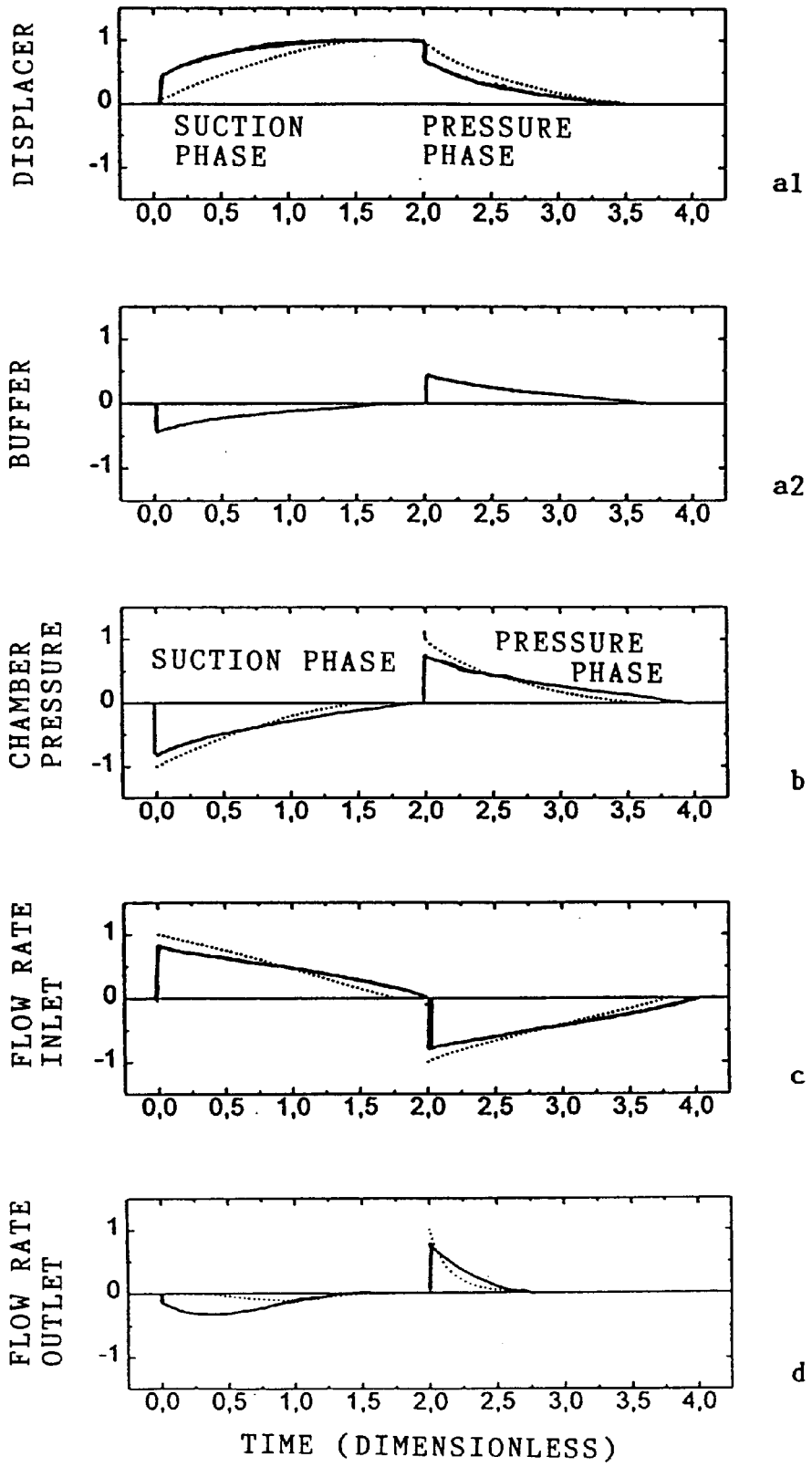
FIGS. 11*a* to 11*d* show representations of the transient processes taking place in a fluid pump according to the present invention including a small buffer volume in the pump chamber.

If elastic components are arranged within the pump chamber or outside of said pump chamber, this will influence the pressure characteristic in the pump chamber as well as the flow rates through the inlet and outlet openings. The elastic components can e.g. be an elastic diaphragm or an elastic media entrapment, such as gas. The transient processes taking place in a pump in this case are shown in FIG. 11.

When the operating frequencies are high, the region of the eigenfrequency of these elastic components in their fluid surroundings will be reached. This will result in a phase displacement between the pressure characteristic in the pump chamber and the movement of the displacer. The relative amounts of the forward and reverse flow through the outlet opening change and the pumping direction is reversed.

The fluid to be moved in the fluid lines is one of the factors determining the resonant frequency. This has the effect that e.g. the threshold frequency, from which a reversal of the direction of transport occurs, becomes lower because of the larger fluid mass as the length of the fluid lines increases. By deliberately introducing elastic components in the area outside of the pump chamber, this undesired coupling between the resonant frequency and the fluid lines can be suppressed.

When only small elastic buffer volumes are present in the pump chamber, the pumping mechanism described will be disturbed very little by said buffer volumes, as can be seen in FIGS. 11*a* to 11*e*. The buffer volume must not exceed a specific size, since, otherwise, the pumping mechanism according to the present invention would no longer be guaranteed.

When, in a fluid pump according to the present invention, no buffer element is provided in or on the pump chamber, the dynamic behaviour of the moving fluid column can be used for the purpose of reversing the pumping direction. When the pump is operated at a frequency which corresponds to the resonant frequency of the moving fluid column, this will result in a phase displacement between the pressure and the movement of the fluid, said phase displacement causing a reversal of the direction of flow.

A reversal of the pumping direction can also be achieved by making use of the dynamic behaviour of the displacer. When the pump is operated at a frequency which corresponds to the resonant frequency of the displacer, a phase displacement between the force driving the displacer and the movement of the displacer will cause a reversal of the pumping direction.

Figure 12:
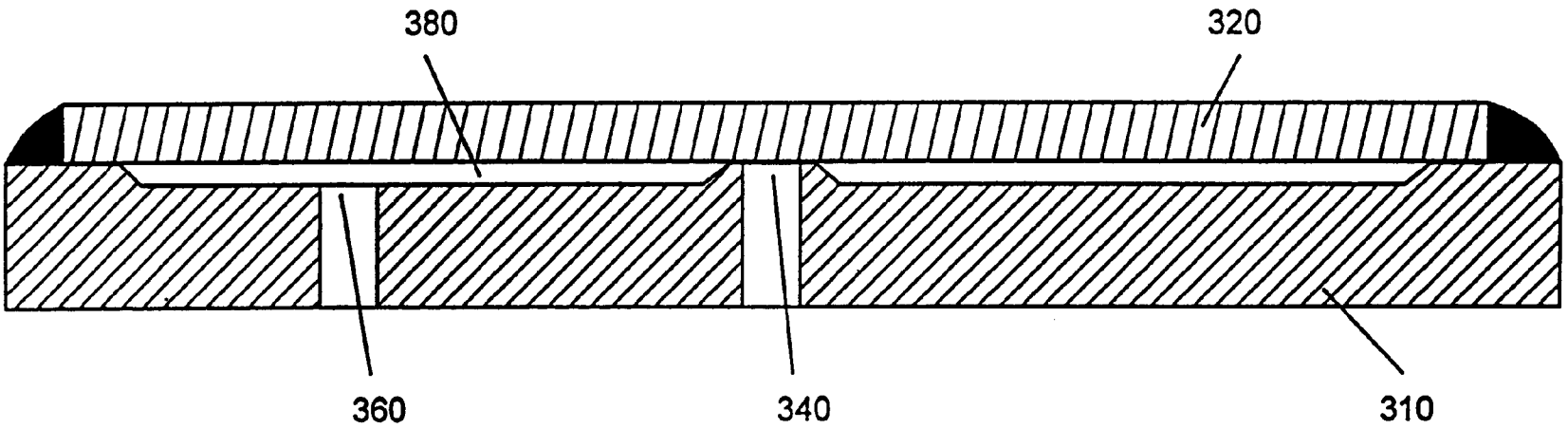
FIG. 12 shows a cross-sectional view of a further embodiment of a fluid pump according to the present invention.

FIG. 12 shows a further embodiment of a fluid pump according to the present invention. In the fluid pump shown in FIG. 12, a pump chamber 380 is formed as a capillary gap between a pump body 310 and a displacer 320. Filling can substantially be simplified on the basis of such an arrangement, since a fluid is drawn into the pump chamber due to the capillary forces. In FIG. 12, the drive mechanism for the displacer means is not shown.

A fluid pump according to the present invention can also be provided with a pressure sensor through which the fluid pump is maintained in the ideal operating range. The pessure sensor can be arranged in or on the pump chamber so as to pick up the pressure prevailing in said pump chamber. For this purpose, the pressure sensor can e.g. be integrated in the displacer 320, which is implemented as a diaphragm, in the embodiment shown in FIG. 12. The drive means of the micropump can then be brought into the respective optimum operating range via a control circuit.

What is claimed is:

1. A fluid pump comprising: a substantially flat, plate-shaped pump body having an outlet opening and an inlet opening formed therethrough in parallel and adjacent to each other, wherein the outlet opening is arranged on center of said pump body, neither said inlet opening nor said outlet opening being provided with a check valve; a plate-shaped displacer connected circumferentially to said pump body such that a pump chamber is defined therebetween, said pump chamber being substantially symmetrical with respect to said outlet opening; drive means for positioning the displacer periodically at a first and at a second position, said drive means having a motive element, said motive element having first and second ends respectively, the first end being attached to the center of the displacer, the second end being attached to a wall of the pump body; the displacer closing said outlet opening when it occupies its first end position and leaving said outlet opening free when it occupies its second end position and leaving the inlet opening free at both end positions thereof, said displacer, when moving from the first to the second end position, defining a flow-through gap which opens between the displacer and the pump body in the area of the outlet opening in dependence upon said movement, said flow-through gap being defined such that the flow through the outlet opening depends on the pressure in the pump chamber as well as on the respective opening degree of said flow-through gap.

2. A fluid pump according to claim 1, wherein the pump body is implemented in the form of a plate including said inlet and outlet openings, and that the displacer is provided with a recess defining together with the pump body the pump chamber.

3. A fluid pump according to claim 1, wherein the pump body is implemented in the form of a plate having inlet and outlet openings, said pump body being additionally provided with a recess defining together with the displacer the pump chamber.

4. A fluid pump according to claim 1, wherein the pump chamber is implemented as a capillary gap.

5. A fluid pump according to claim 1, wherein the cross-sectional area of the inlet opening is reduced in comparison with the cross-sectional area of the outlet opening.

6. A fluid pump according to claim 1, wherein the drive means is a piezoelectric bending converter, said piezoelectric bending converter bending upwards when voltage is applied, said central portion of said displacer moving upwards and opening said outlet opening, said converter returning to said first end position when voltage is switched off and closing said outlet opening.

7. A fluid pump according to claim 1, wherein the drive means consists of a piezo plate applied to the side of the displacer located opposite the pump body.

8. A fluid pump according to claim 1, wherein the drive means is an electrostatic drive.

9. A fluid pump according to claim 1, wherein the displacer closes the outlet opening passively when the pump has been switched off.

10. A fluid pump according to claim 1, wherein the displacer closes the outlet opening by applying a voltage with opposite sign to the drive means.

11. A fluid pump according to claim 1, wherein a pressure sensor is arranged in or on the pump chamber, said pressure sensor being used for forming a control circuit.

* * * * *